US009454883B2

(12) United States Patent
Young

(10) Patent No.: US 9,454,883 B2
(45) Date of Patent: Sep. 27, 2016

(54) DETECTION DEVICE

(71) Applicant: Peter Jeffrey Young, King's Lynn Norfolk (GB)

(72) Inventor: Peter Jeffrey Young, King's Lynn Norfolk (GB)

( * ) Notice: Subject to any disclaimer, the term of this patent is extended or adjusted under 35 U.S.C. 154(b) by 246 days.

(21) Appl. No.: 14/349,057

(22) PCT Filed: Oct. 1, 2012

(86) PCT No.: PCT/GB2012/052427

§ 371 (c)(1),
(2) Date: Apr. 1, 2014

(87) PCT Pub. No.: WO2013/045954

PCT Pub. Date: Apr. 4, 2013

(65) Prior Publication Data

US 2014/0247128 A1 Sep. 4, 2014

(30) Foreign Application Priority Data

Oct. 1, 2011 (GB) ..... 1116932.3

(51) Int. Cl.

| | |
|---|---|
| ***G08B 13/00*** | (2006.01) |
| ***G08B 13/08*** | (2006.01) |
| ***G08B 3/10*** | (2006.01) |
| *G08B 29/16* | (2006.01) |

(52) U.S. Cl.
CPC ..... *G08B 13/08* (2013.01); *G08B 3/10* (2013.01); *G08B 29/16* (2013.01)

(58) Field of Classification Search
CPC .... G08B 13/008; G08B 13/10; G08B 13/14; G08B 13/1481; A47F 3/002
See application file for complete search history.

(56) References Cited

U.S. PATENT DOCUMENTS

| | | | | |
|---|---|---|---|---|
| 3,686,660 | A | 8/1972 | Massover et al. | |
| 3,696,379 | A * | 10/1972 | Minasy | G08B 13/2488 340/505 |
| 3,895,599 | A * | 7/1975 | Berkowitz | G08B 13/08 116/164 |
| 3,967,260 | A * | 6/1976 | Massa | G08B 13/1627 367/901 |
| 4,052,718 | A | 10/1977 | Tucci et al. | |
| 4,172,254 | A * | 10/1979 | Vermillion | G08B 13/08 200/61.67 |
| 4,343,043 | A * | 8/1982 | McLennan | G04G 13/028 381/109 |
| 4,595,903 | A * | 6/1986 | Arlasky | B60R 25/045 180/289 |
| 5,281,952 | A | 1/1994 | Dragan | |
| 6,963,280 | B2 | 11/2005 | Eskildsen | |
| 7,557,712 | B2 | 7/2009 | Shelton et al. | |
| 7,916,018 | B2 | 3/2011 | Eskildsen et al. | |
| 7,986,232 | B2 | 7/2011 | Sharma | |
| 2005/0035882 | A1 * | 2/2005 | Vassallo | G07B 13/00 340/988 |
| 2005/0161420 | A1 | 7/2005 | Hardy et al. | |
| 2005/0253702 | A1 * | 11/2005 | Moyer | G08B 13/1472 340/539.11 |
| 2008/0157964 | A1 * | 7/2008 | Eskildsen | G08B 13/08 340/545.1 |

(Continued)

FOREIGN PATENT DOCUMENTS

| | | | |
|---|---|---|---|
| GB | 2283603 | A | 5/1995 |
| GB | 2447049 | A | 9/2008 |
| JP | 2004234400 | A | 8/2004 |

(Continued)

*Primary Examiner* — Kerri McNally
*Assistant Examiner* — Renee Dorsey
(74) *Attorney, Agent, or Firm* — Baker & Hostetler LLP

(57) ABSTRACT

A device for the detection of an open and unattended closure of an enclosure to prevent theft comprises a detector adapted to detect if the closure is open and a detector adapted to detect if the closure is unattended, the detectors being operably connected to an effector adapted to alert a user to the open and unattended condition of the closure.

31 Claims, 4 Drawing Sheets

(56) References Cited

U.S. PATENT DOCUMENTS

| | | | | |
|---|---|---|---|---|
| 2010/0052903 | A1* | 3/2010 | Tiwari | G08B 25/003 340/541 |
| 2010/0123580 | A1* | 5/2010 | Marmigere | B65D 5/4212 340/545.6 |

FOREIGN PATENT DOCUMENTS

| | | | |
|---|---|---|---|
| WO | 2006079218 | A1 | 8/2006 |
| WO | 2008119807 | A2 | 10/2008 |
| WO | 2010057533 | A1 | 5/2010 |

* cited by examiner

DETECTION DEVICE

CROSS-REFERENCE TO RELATED APPLICATIONS

This application is a National Stage of International patent application PCT/GB2012/052427, filed on Oct. 1, 2012, which claims priority to foreign United Kingdom patent application No. GB 1116932.3, filed on Oct. 1, 2011, the disclosures of which are incorporated by reference in their entirety.

FIELD OF THE INVENTION

The present invention relates to a detection device, more particularly to a device for the detection of an open and unattended closure to an enclosure.

BACKGROUND

It is important in some environments to ensure that doors into enclosures, such as cupboards, cabinets, boxes, drawers, or rooms, are not left open and unattended. For example, in the medical environment, drug cupboards and drug trolleys need to be used unimpeded for periods of time by staff but must not be left accessible without a member of staff present. On a busy hospital ward, it is very easy for a drug cupboard or drug trolley to be accidently left open and unattended and this has led to theft of controlled substances. This is highly undesirable and a balance has to be found between the practical use of a drug cupboard or drug trolley and securing the contents of these enclosures.

There are several types of device that have been used to secure doors and entranceways, however, most of these devices relate to unauthorised access rather than ensuring that doors are not left open and unattended. For example, U.S. Pat. No. 5,281,952 describes a device that allows an authorised person to determine if an unauthorised person has accessed a room. The device disclosed therein is triggered by light and, if an unauthorised user enters the room, the device will emit an audible alarm for a pre-determined amount of time. This device is one of many devices that detect light, movement, or temperature changes to determine if a door has been opened. However, this type of alarm is not suitable in every environment and for every situation. As stated above, in the medical environment, drug cupboards and drug trolleys need to be used unimpeded for periods of time by staff on hospital wards and, in such circumstances, an alarm that sounds constantly when the door is opened is highly undesirable.

Another approach is described in GB 2283603, where the device disclosed therein consists of an alarm unit and a magnet. When the alarm unit and magnet are separated for more than ten seconds, the alarm unit emits a sound. Again, this is not suitable in many environments and this approach is not useful for an enclosure that needs to be used unimpeded for potentially long periods of time.

Yet another example is a refrigerator alarm. Many refrigerators, for example by the Samsung group, have an alarm which is time based to remind users to close the door if left open for a predetermined time. This is helpful under most circumstances however can cause annoyance at times when the user wishes to leave the door open for a prolonged time, for example whilst transferring a weekly load of provisions into the refrigerator.

One device specifically designed to secure drug cabinets is the Controlled Drug Cabinet Alarm as sold by the FPD Group. This alarm is activated when the cabinet door is unlocked and an external red warning light is displayed to alert a user. After a pre-determined period of time a warning alarm or beep sounds. A disadvantage of this device is that the alarm will sound even if the user still requires the cabinet door to be open. Also, in order to turn off the alarm, the cabinet door would have to be closed which can lead to an inefficient use of time for the user if they still require access to the cabinet and would need to immediately reopen the doors.

Another device that calls a user's attention to an open drugs cabinet is the Nurse Station Unit made by Wandsworth. This device has a light provided on a control panel which indicates when the door of a drug cabinet has been opened. This could easily be missed by a busy nurse and also has the disadvantage of not indicating if the drugs cabinet is actually in use.

SUMMARY OF THE INVENTION

It is an object of the present invention to overcome the above-mentioned disadvantages of the prior art.

According to a first aspect of the invention, there is provided a device for the detection of an open and unattended closure of an enclosure to prevent theft, comprising: a detector adapted to detect if the closure is open and a detector adapted to detect if the closure is unattended, the detectors being operably connected to an effector adapted to alert a user to the open and unattended condition of the closure.

This device, unlike the prior art, has the advantage that it can detect that the enclosure is both open and unattended. Therefore, the device will only alert the user if both conditions apply and not just after a pre-determined time period has elapsed.

The device of the present invention is particularly useful in environments where alarms are intrusive and undesirable.

Preferably, the detector adapted to detect if the closure is open is also adapted to turn the device on upon opening of the closure and off when the closure is returned to a shut position. This allows for an efficient use of power to the device and assists in ensuring that the device will only be operational when required.

Preferably, the detector adapted to detect if the closure is unattended is also adapted to turn the device off for a pre-determined period of time when actuated by the proximity of a user, or to actuate the effector if the proximity of a user is not detected. This detector also allows for efficient use of power as the device is switched off after the detector has been triggered. Additionally, as the detector turns the device off when it is activated and only triggers the effector when is not activated, it provides a system which will only trigger the alarm if the device is unattended.

Preferably, the effector adapted to alert a user to the open and unattended condition of the closure is also adapted to deactivate if the detector adapted to detect if the closure is open detects that the closure has been returned to a closed position, or if the detector adapted to detect if the closure is unattended detects the proximity of a user. Once the alarm has sounded, either the closure being closed or a user accessing the opening of the enclosure can reset the device. Therefore, if the alarm is triggered, the user will be reminded to close the open closure or, if the enclosure is still in use, simply return to the enclosure. In a preferred embodiment, the device of the present invention continually monitors and detects both light and movement. In one embodiment, the detection of movement causes the device to be switched off and the timer to be reset for a pre-determined period of time. In another embodiment, the activated timer may be reset, for example, after detecting movement. In this embodiment the timer will be continuously reset provided there is movement in a predetermined proximity to the closure.

Preferably, the length of the pre-determined period of time is variable by a user. The ability to alter the time period in which the device is switched off after the detector adapted to detect if the closure has been opened, allows for flexibility within the system. For example, if the device is fitted to a drug trolley or drug cabinet, then the time period may advantageously be shorter, for example, when used in smaller hospital wards and longer, for example, when used in larger hospital wards. In a preferred embodiment, the predetermined period of time is between one and four minutes, and preferably two minutes.

Preferably, the detector adapted to detect if the closure is open is a light detector adapted to activate by the presence of light and deactivate in darkness. Light detectors have the advantage that they are readily able to determine if the enclosure has been opened and are readily available, cheap to manufacture and have a proven reliability.

Preferably, the detector adapted to detect if the closure is open is a magnetic switch adapted to activate by the opening of the closure and deactivate when the closure is returned to a closed position. Advantageously, the use of a magnetic switch ensures that the device is only activated when the closure is open. Additionally, a magnetic switch may advantageously function in all environments without further adaption, for example, such a switch may be used in low light environments.

Preferably, the detector adapted to detect if the closure is open comprises both a magnetic switch and a light detector which are adapted to activate in series or parallel upon opening of the closure, and deactivate when the closure is returned to a shut position. This combination advantageously allows for all eventualities and creates a system that ensures that the device is activated when the closure is open.

Preferably, the detector adapted to detect if the closure is open is adapted to activate and deactivate by accessing a manual or electronic lock. This provides an efficient way of determining whether an enclosure is secure. If the device were linked to the lock of an enclosure, then the device would be activated even if the closure was not fully opened.

Preferably, the detector adapted to detect if the closure is unattended is a passive infrared proximity sensor. Advantageously, the use of a proximity sensor detects the movement of a user as they access the opening to the enclosure and therefore detects if the closure is attended or unattended.

Preferably, the range of the proximity sensor can be varied. Varying the range by which the proximity sensor can detect movement in this manner has the advantage that it allows the user to alter the sensitivity of the device. In certain environments, it may be advantageous to ensure that the sensor is not activated by a passer by and is only activated by someone accessing the opening of the enclosure. In an alternative situation, it may be advantageous for a user not to be required to fully return to the opening of the enclosure in order to prevent triggering of the alarm.

Preferably, the effector adapted to alert a user to the open and unattended condition of the closure is an audio alarm. Advantageously, an audio alarm is readily able to alert a user to the open and unattended closure and may do so even if the enclosure is not in the line of sight of the user.

Preferably, the effector adapted to alert a user to the open and unattended condition of the closure is a visual alarm. The use of such a visual alarm is highly advantageous as it may alert a user in environments where sound would be undesirable.

Preferably, the effector adapted to alert a user to the open and unattended condition of the closure is both an audio and visual alarm. The use of both an audio and visual alarm would have the advantage of being much more likely to alert a user to the open and unattended condition of the closure.

Preferably, the effector adapted to alert a user to the open and unattended condition of the closure remotely activates an alarm. In this embodiment the effector can trigger an alarm that is not located on the device. This is advantageous in environments which have a central area which is constantly manned, where the alarm would be noticed and acted upon immediately.

Preferably, once the effector adapted to alert a user to the open and unattended condition of the closure is activated it produces an intermittent crescendo alarm between a minimum and maximum setting. This type of alarm is as unobtrusive as possible and is advantageous in environments where an alarm would be undesirable.

Preferably, the minimum and maximum settings of the device are variable. This is advantageous as it provides flexibility and allows the settings of the device to be tailored to its environment.

Preferably, the effector adapted to alert a user to the open and unattended condition of the closure produces a continuous alarm after the maximum setting of the crescendo alarm has been reached. This allows a user time to prevent the full alarm from triggering but also ensures that the users attention is drawn to the enclosure after a long period of unattendance.

Preferably, the effector adapted to alert a user to the open and unattended condition of the closure automatically closes the closure when activated. This is advantageous as the closure may be automatically returned to a shut position if the alarm is activated.

Preferably, the device further comprises a means for automatically locking the closure when in a closed position. This feature has the advantage that it allows the closure to be automatically secured if the alarm is triggered.

Preferably, the effector adapted to alert a user to the open and unattended condition of the closure provides an alarm having a frequency of between 15 and 20 kHz. In some cases, such frequencies may not be heard by elderly patients who may suffer from an age-related loss of hearing. Advantageously, the frequency range of the alarm has the effect that that it will not disturb elderly patients, but will be still heard by and alert the younger medical staff.

Preferably, the device further comprises a video and/or audio recording system. Preferably, deactivation of the detector adapted to detect if the closure is unattended activates the video and/or audio recording system. In a preferred embodiment, the video and/or audio recording system is external to the device such as a closed circuit camera used with closed circuit television (CCTV). This is advantageous as it provides the user with the facility to monitor the device from a remote location and to observe the device at a later time. In addition, it may allow the user to view and identify the person or persons who may have tampered with the device.

Preferably, the device further comprises a keyless operating system. Advantageously, such a keyless operating system adds an additional level of security to prevent unauthorised access.

Preferably, the device functions under normal conditions in the presence of a keyless authorisation pass and emits a continuous alarm at the maximum setting if the closure is opened by a user without a keyless authorisation pass. As only authorised users carrying the keyless pass can approach the enclosure closure, this feature would deter potential unauthorised persons from approaching the closure of the enclosure.

Preferably, the device functions under normal conditions in the presence of at least two keyless authorisation passes. It may be advantageous to ensure that the contents of an enclosure are not accessible unless two authorised people are present. This feature would ensure that only authorised individuals could properly access the contents of the enclosure.

Preferably, the device further comprises a tamper alarm system. Advantageously, such a tamper alarm may help to prevent the unauthorised deactivation or removal of the device.

Preferably, the tamper alarm system comprises light sensitive, physical or magnetic switches. These components have the advantage that they may be used to create a tamper alarm that is robust and cheap to manufacture.

Preferably, the invention further comprises a cradle for securing the device. The use of a cradle has the advantage that it secures the device to the enclosure and prevents the device from being removed from the enclosure by an unauthorised person.

Preferably, the detector adapted to detect if the closure is open is a relative light sensor for detecting opening of the closure in low light environments. A relative light sensor would advantageously allow the device to work in low light level environments.

Preferably, the closure is a closure to a drug cabinet or drug trolley. Ensuring that the closure of a drug cabinet and drug trolley is not left open and unattended can be highly critical. Drugs can be expensive to purchase and the theft of such drugs can lead to a high economic burden on hospitals. Also, there is the potential that the stolen (either controlled or non-controlled) drugs are taken in an unsafe manner that could lead to overdose or, in some cases, even fatality. In addition, the present invention advantageously reduces the potential for the tampering of drugs that may be stored within the cabinet or trolley.

BRIEF DESCRIPTION OF THE DRAWINGS

The present invention will now be described, by way of example only, with reference to the accompanying drawings, in which.

DETAILED DESCRIPTION

Figure 1:
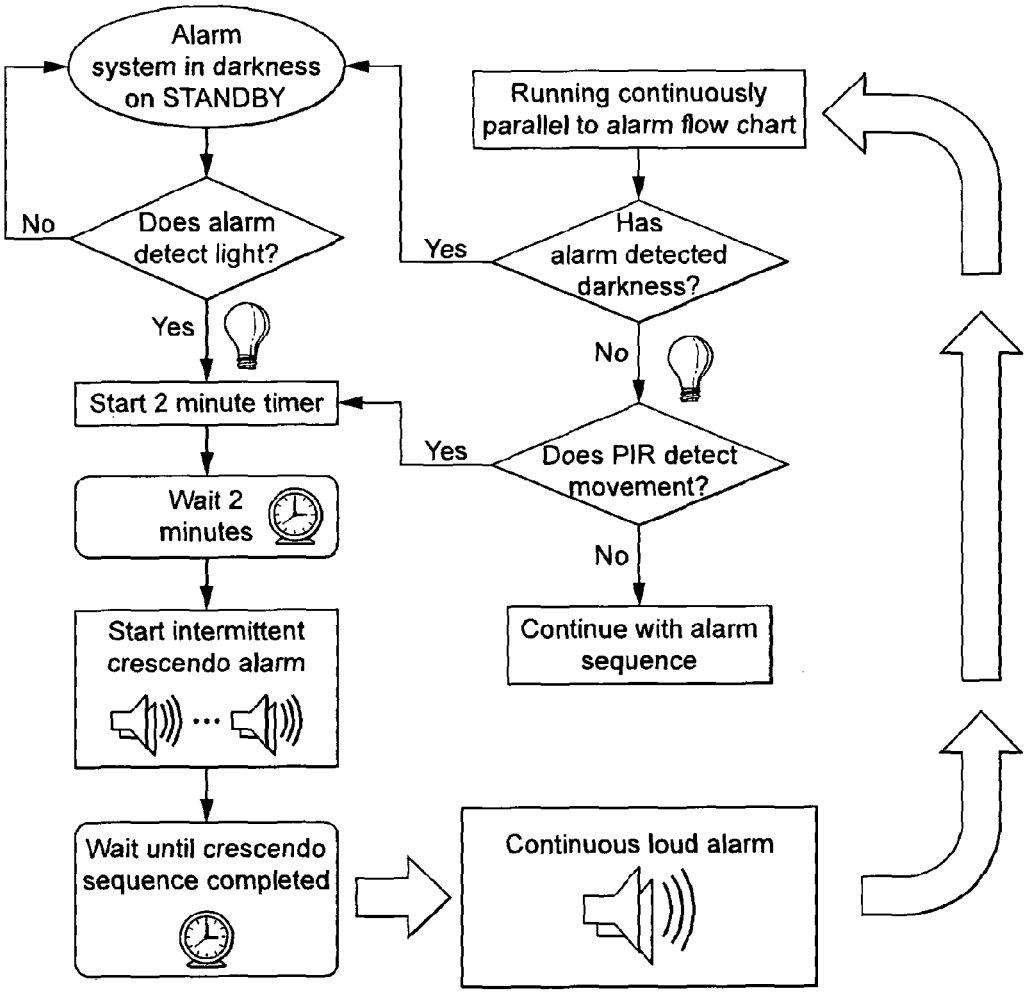
FIG. 1 is a flow chart of the alarm system according to an embodiment of the invention.

Referring to the drawings, there is illustrated a device for the detection of an open and unattended closure of an enclosure to prevent theft, comprising: a detector adapted to detect if the closure is open (1) and a detector adapted to detect if the closure is unattended (4), the detectors being operably connected to an effector adapted to alert a user to the open and unattended condition of the closure (5).

The alarm is on standby when the door to an enclosed space is closed. Upon opening of the door, the device detects light and movement. The detection of such light and movement causes a timer to be activated for a pre-determined period of time. After the pre-determined period of time has elapsed, an intermittent crescendo alarm is initiated, which increases in volume between a minimum and a maximum setting. Once the crescendo sequence is complete, the device emits a continuous loud alarm. The alarm may be switched off, either by closing the door such that the device is in darkness, or by detecting movement, for example, near the proximity of the door. In the situation where the device detects movement, the device is turned off for a pre-determined period of time and the timer is reset. Advantageously, the device of the present invention continually monitors and detects light and movement. In one embodiment, when the device is switched off and in the stand-by configuration, the detection of movement causes the timer to be reset. In one embodiment, the pre-determined period of time in which the timer is activated is two minutes. In another embodiment, the activated timer may be reset, for example, after detecting movement.

The skilled person would understand that the present invention may be embodied in a number of different ways. The following example illustrates one way in which the present invention can be successfully embodied.

Figure 2A:
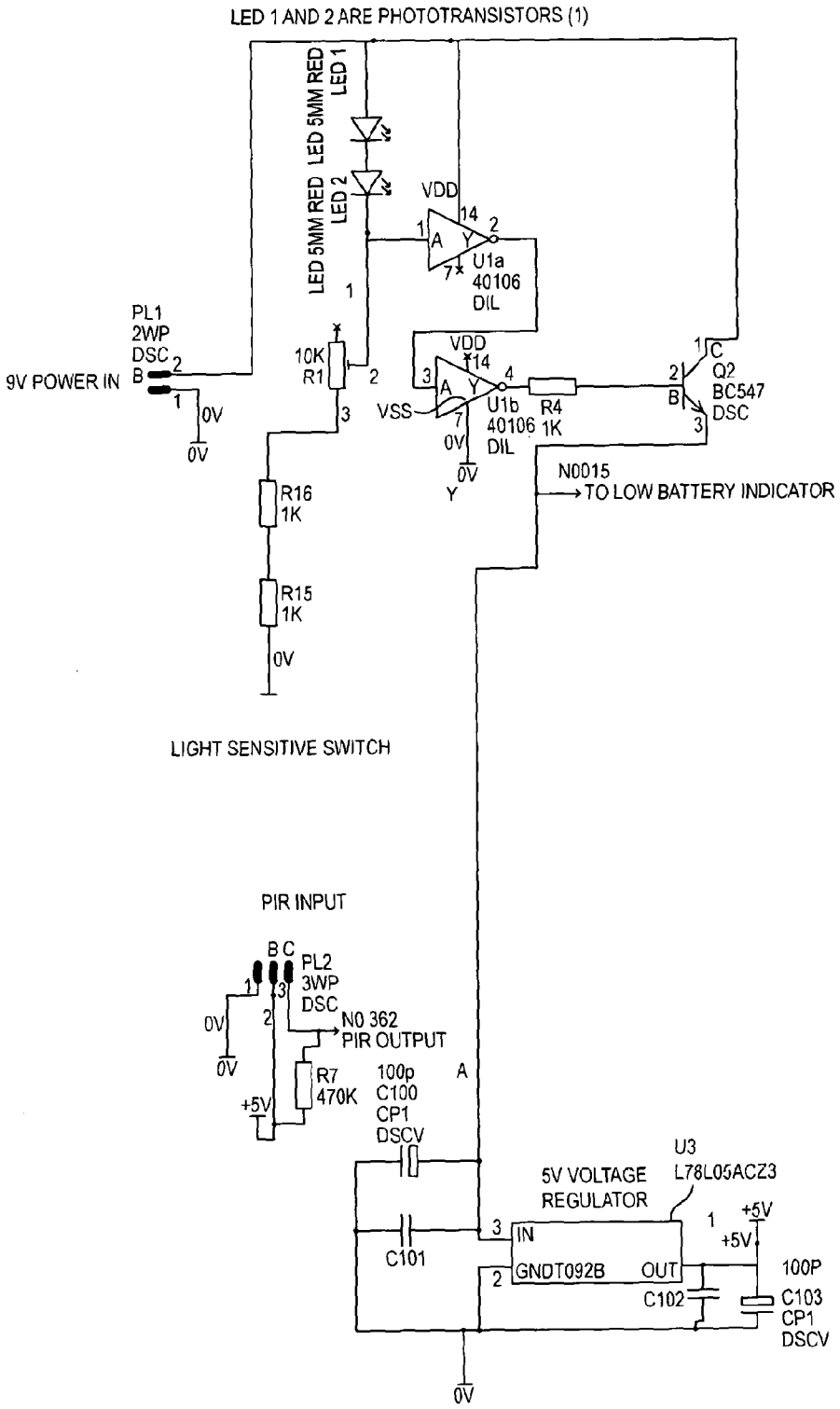
FIGS. 2A, B, and C show a schematic representation of a circuit board for the alarm system of FIG. 1.

FIGS. 2A, B and C show a schematic for the circuit board of one embodiment of the invention. In FIG. 2A, the analogue response of the light sensitive diode (designated LED 1 and 2 on the schematic) (1) is converted into a digital signal by means of a voltage divider involving resistors R1, R15 and 16. As this is under power continuously, it is an extremely high resistance circuit to minimise standby current consumption and, as such, two light sensitive diodes in series have been incorporated to increase the sensitivity to light.

R1 is a variable resistor which will allow the light sensitivity to be adjusted. This circuit is an absolute light intensity switch, however, in another embodiment the light intensity switch could be converted to a relative light intensity switch by placing a further light sensitive diode between R1 and R15 and placing this on the outside of the enclosure. Neither this nor the second light sensitive diode designated LED 2 have been included, and have been shorted across with a wire link.

The output of this potential divider has been fed to the input of a 40106 NOT gate (U1*a*). As such, as the light intensity on LED 1 rises, its resistance falls, the potential difference on the input of this gate rises and when it reaches its threshold value, the NOT gate flips state (from ON to OFF). A second NOT gate (U1*b*) reverses this state such that it is off when the LED1 is in darkness.

These NOT gates are Schmitt Trigger circuits and, as such, exhibit hysteresis behaviour, which in practice means that the light intensity required to turn on the alarm is higher than that needed to turn it off. In other words, as cupboards at night are often opened in lighter areas and can be moved to darker areas, the alarm may still be active.

The output of U1*b* is fed into a BC547 NPN transistor Q2. The output of this is fed into a 5 v voltage regulator U3 such that a constant 5 v output is delivered. This is suitable for the supply of the TTL PIR (Position Infrared) module (4), and also remains constant as the battery voltage begins to fall. The output of this is used to power the integrated circuits for the next part of the circuit (termed +5 v on the schematic).

Figure 2B:
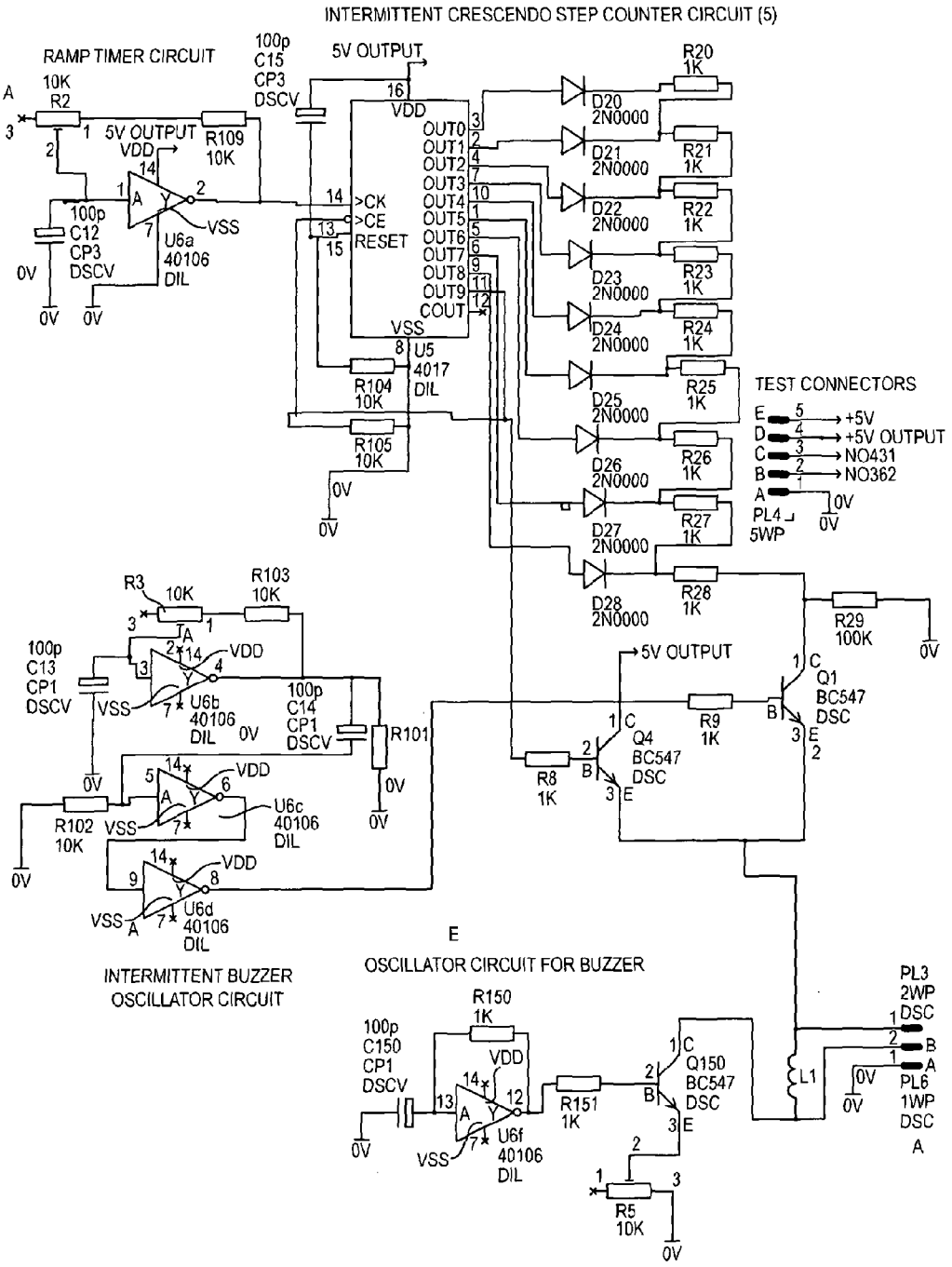

FIG. 2B shows a timer circuit (2) based on 2 Schmitt Trigger NAND gates (U4*a* and U4*b*) in conjunction with a capacitor (C7) and resistors R6 and R12 the latter components determining the time delay. The variable resistor R6 allows the time interval to be varied from a minimum which is determined by R12.

The timer (2) is activated when input B of U4*a* is momentarily connected to earth using transistor Q6 as a switch. This occurs when the circuit is powered up, by means of capacitor C18. One problem with this circuit is that retriggering (i.e. restarting the timer (2) before it has completed) is unreliable. Retriggering is enabled by means of transistor Q3 which discharges capacitor C7 through resistor R14. The output is inverted by U4*c* and is one of two inputs to the U4*d*. The PIR module (4) is also powered by the voltage regulator and the output of this is the second input to U4*d*. The output of the (4) module is also connected to the base of transistors Q3 and Q6 thus resetting the timer (2) as described above. As the PIR module (4) used here is a TTL device the output is tied to the 5 v supply by means of a resistor (R7) such that it becomes compatible with the CMOS circuitry.

Figure 2C:
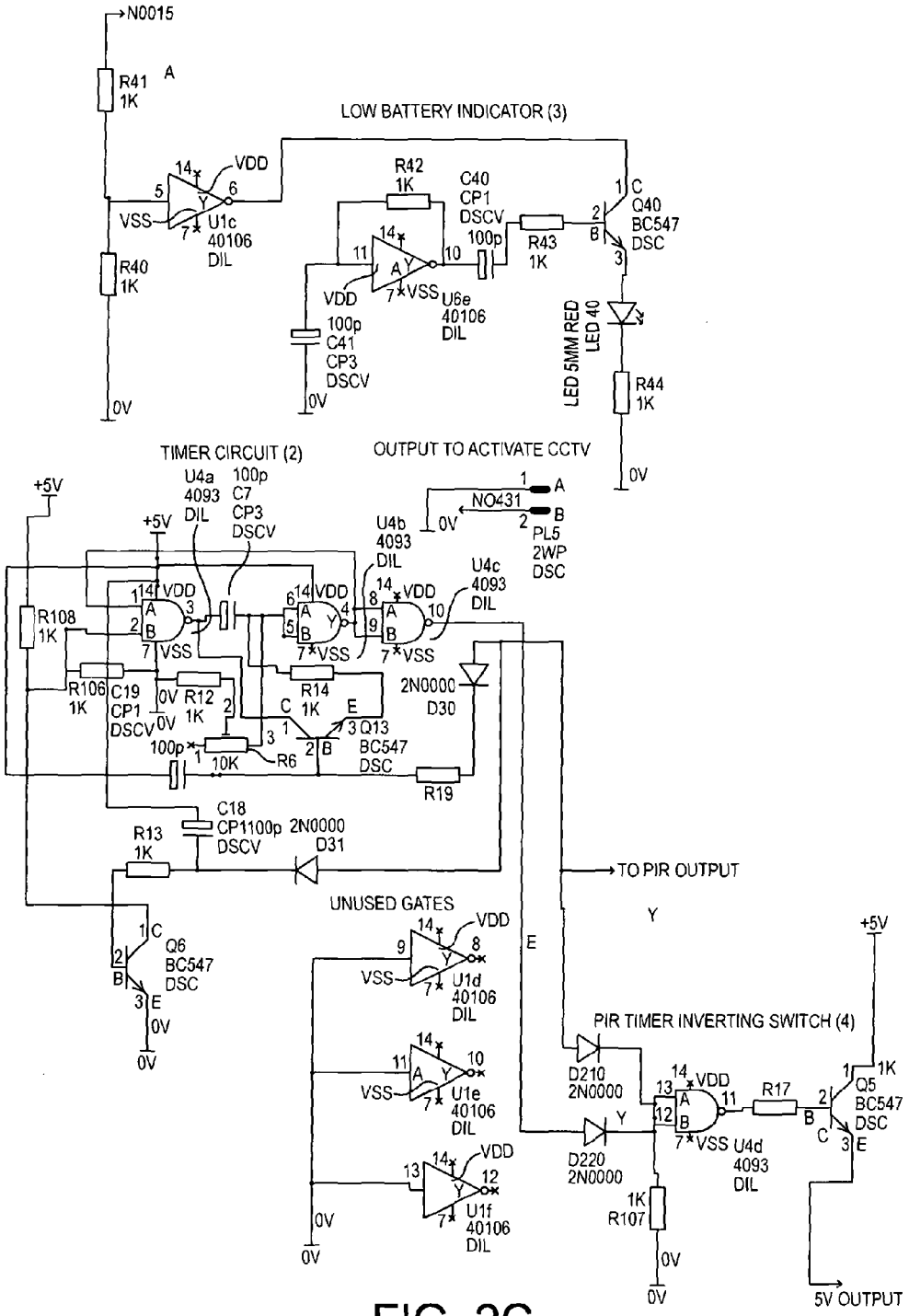

The output of U4*d* is used (via transistor Q5 as a switch) to power the next part of the circuit, which is the audio generating circuitry (5), as shown in FIG. 2C. This output is termed 5 v output on the schematic.

The audio generating circuitry (5) is based around 3 Schmitt Trigger NOT gate oscillators (U6*a*, U6*b* and U6*f*) which provide the rate of crescendo, the interval of beeps and the frequency of sound, respectively.

The first oscillator based around the U6*a* oscillator provides a square wave with a frequency adjustable via R2 from a minimum frequency determined by R. This provides a clock input to the decade counter 4017 (U5). This arrangement provides the volume crescendo mechanism as each of the ten outputs connects to the next resistor in a series of nine resistors. This means that, with each input pulse from U6*a* the output passes through a sequentially smaller resistance i.e., output 0 through 9 resistors output 1 through 8 and so on until it reaches the final output (labelled out 9 on the schematic) where there is no resistor and hence the sound will be loudest. Ordinarily the sequential output would simply begin again, but to keep the output on this level this output is connected to the "clock enable" input which holds the output on that level.

To ensure the sequence always starts on the first output (labelled out 0 on the schematic) a capacitor (C15) provides a momentary pulse to the "reset" connector when this part of the circuit receives power. The circuit then creates a stepwise increasing voltage which is held at the maximum value.

To create a series of short beeps, a second oscillator (based around U6*b*) creates a further higher frequency (again adjustable) square wave which switches the sound on and off at the transistor Q1. In this embodiment, the sound may then be on for an equal time to that which it is off, i.e., a rather long beep which would be shortened by means of capacitor C14. The resulting exponentially decaying voltage is converted to a clean square wave by means of 2 NOT gates (U6*c* and U6*d*) in series. The final output (labelled "out 9", as described above) switches on the sound by means of transistor Q4.

To create the high frequency square wave required to drive the piezoelectric transducer, the third oscillator (based on U6*f* as described above) delivers this via transistor Q150. This sound is amplified via an inductor coil (L1) placed across the piezoelectric element.

A low battery indicator (3), as shown in FIG. 2B, is present based on a potential divider of R40 and R41 placed across the output of transistor Q2. This means that this part of the circuit is only drawing current when the enclosure is open. In one embodiment, the circuit is designed to flash a light (LED 40). An alternative embodiment comprises a circuit which is designed to have an intermittent beep sounding.

This circuit is designed with maximum user simplicity in mind such that the device can simply be attached to a drug trolley without requiring further accessories, expense or training.

In a further embodiment, the device may be configured to trigger a closed circuit camera, either in the immediate vicinity of the device, or as part of a system. In this setting, the output of the timer (i.e. the output of U4*c*), which is connected to connector PL5, could be used via an optical isolator to trigger the camera.

In this embodiment, the camera would be activated for two minutes when the drug trolley is opened, and for a further two minutes every time the PIR detector (4), as shown in FIG. 2B, detects movement. In other words, when someone approaching the trolley inactivates the audible alarm, their presence will activate the closed circuit camera. In one embodiment, such a closed circuit camera may be used with closed circuit television (CCTV).

Similarly, in another embodiment, the system could be modified such that a keyless operating system could be incorporated such that proximity to a pass holder would cause the alarm to operate in a manner as described above. If an unauthorised person approached the device, an immediate loud and constant alarm will result. For certain situations, for example controlled drug cupboards where two practitioners are required, the system may be configurable to require two proximity passes to achieve the normal functioning of the device.

In yet another embodiment, a tamper alarm system may be integrated into the device. The tamper alarm system may consist of light sensitive, physical or magnetic switches designed to elicit a constant maximal volume alarm if the unit is removed or tampered with. A cradle may be firmly attached to the wall of the drug cabinet or trolley into which the alarm unit has been fitted in a removable manner, which inactivates the tamper alarm when the device is in situ.

Additionally, in any of the stated embodiments, the device may have a hardwired battery, such that when this is exhausted a replacement device may easily be slid into place on the cradle. Since the cradle would be firmly adhered to the trolley, if the device has been removed, it will be very clear from the empty cradle.

The invention claimed is:

1. A device for the detection of an open and unattended closure of an enclosure to prevent theft, comprising: a detector adapted to detect if the closure is open and a detector adapted to detect if the closure is unattended, the detectors being operably connected to an effector adapted to alert a user to the open and unattended condition of the closure, wherein the detector adapted to detect if the closure is open is also adapted to turn the device on upon opening of the closure and off when the closure is returned to a shut position.

2. The device of claim 1, wherein the detector adapted to detect if the closure is unattended is also adapted to turn the device off for a pre-determined period of time when actuated by the proximity of a user, or to actuate the effector if the proximity of a user is not detected.

3. The device of claim 2, wherein the effector adapted to alert a user to the open and unattended condition of the closure is also adapted to deactivate if the detector adapted to detect if the closure is open detects that the closure has been returned to a shut position, or if the detector adapted to detect if the closure is unattended detects the proximity of a user.

4. The device of claim 2, wherein the length of the pre-determined period of time is variable by a user.

5. The device according to claim 1, wherein the detector adapted to detect if the closure is open is a light detector adapted to activate by the presence of light and deactivate in darkness.

6. The device according to claim 1, wherein the detector adapted to detect if the closure is open is a magnetic switch adapted to activate by the opening of the closure and deactivate when the closure is returned to a shut position.

7. The device according to claim 1, wherein the detector adapted to detect if the closure is open comprises both a magnetic switch and a light detector which are adapted to activate in series or parallel upon opening of the closure and deactivate when the closure is returned to a shut position.

8. The device according to claim 1, wherein the detector adapted to detect if the closure is open is adapted to activate and deactivate by accessing a manual or electronic lock.

9. The device of claim 1, wherein, the detector adapted to detect if the closure is unattended is a passive infrared proximity sensor.

10. The device of claim 9, wherein the range of the proximity sensor can be varied.

11. The device of claim 1, wherein the effector adapted to alert a user to the open and unattended condition of the closure is an audio alarm.

12. The device of claim 1, wherein the effector adapted to alert a user to the open and unattended condition of the closure is a visual alarm.

13. The device of claim 1, wherein the effector adapted to alert a user to the open and unattended condition of the closure is both an audio and visual alarm.

14. The device of claim 1, wherein the effector adapted to alert a user to the open and unattended condition of the closure remotely activates an alarm.

15. The device of claim 1, wherein once the effector adapted to alert a user to the open and unattended condition of the closure is activated it produces an intermittent crescendo alarm between a minimum and maximum setting.

16. The device of claim 15, wherein the minimum and maximum settings of the device are variable.

17. The device of claim 15, wherein the effector adapted to alert a user to the open and unattended condition of the closure produces a continuous alarm after the maximum setting of the crescendo alarm is reached.

18. The device of claim 1, wherein the effector adapted to alert a user to the open and unattended condition of the closure automatically closes the closure when activated.

19. The device of claim 18, wherein the device further comprises a means for automatically locking the closure upon closure.

20. The device of claim 1, wherein the effector adapted to alert a user to the open and unattended closure provides an alarm having a frequency of between 15 and 20 kHz.

21. The device of claim 1, further comprising a video and/or audio recording system.

22. The device of claim 21, wherein deactivation of the detector adapted to detect if the closure is unattended activates the video and/or audio recording system.

23. The device of claim 22, wherein the video and/or audio recording system is external to the device.

24. The device of claim 1, further comprising a keyless operating system.

25. The device of claim 24, wherein the device functions under normal conditions in the presence of a keyless authorisation pass and emits a continuous alarm at the maximum setting if the closure is opened by a user without a keyless authorization pass.

26. The device of claim 25, wherein the device functions under normal conditions in the presence of at least two keyless authorization passes.

27. The device of claim 1, wherein the device further comprises a tamper alarm system.

28. The device of claim 27, wherein the tamper alarm system comprises light sensitive, physical or magnetic switches.

29. The device of claim 1, further comprising a cradle for securing the device.

30. The device of claim 1, wherein the detector adapted to detect if the closure is open is a relative light sensor for detecting opening of the closure in low light environments.

31. The device of claim 1, wherein the closure is a closure to a drug cabinet or drug trolley.

* * * * *